US005819857A

United States Patent [19]

Rohrer

[11] Patent Number: 5,819,857

[45] Date of Patent: Oct. 13, 1998

[54] PORTABLE POST DRIVING APPARATUS

[76] Inventor: Daniel F. Rohrer, 3068 S. Reif Rd., Powell Butte, Oreg. 97753

[21] Appl. No.: 874,871

[22] Filed: Jun. 13, 1997

[51] Int. Cl.[6] ..... B25D 9/08; E02D 7/10

[52] U.S. Cl. ..... 173/90; 173/32; 173/128; 173/132

[58] Field of Search ..... 173/30, 90, 91, 173/206, 128, 132, 133, 126, 32; 405/232

[56] References Cited

U.S. PATENT DOCUMENTS

| | | | |
|---|---|---|---|
| 2,392,061 | 1/1946 | Pfeiffer | 173/90 |
| 2,882,690 | 4/1959 | Frederick | 173/128 |
| 2,988,158 | 6/1961 | Baldwin | 173/132 |
| 3,566,977 | 3/1971 | Wandell | 173/90 |
| 4,665,994 | 5/1987 | Snider | 173/128 |
| 5,174,388 | 12/1992 | Williams et al. | 173/90 |
| 5,662,175 | 9/1997 | Warrington et al. | 173/128 |

*Primary Examiner*—Scott A. Smith

*Attorney, Agent, or Firm*—Robert E. Howard

[57] ABSTRACT

A portable power driven post driver. The post driver has an inner hollow cylinder open at its upper end and adapted to receive a post through a locking mechanism located at its lower end. The inner cylinder is located within an outer hollow cylinder in sliding engagement therewith, the outer cylinder having a closed upper end in contact with the upper end of a post held in said inner cylinder. Two fluid powered cylinders and associated pistons are attached to the outer surface of the outer cylinder, the longitudinal axes of the two fluid powered cylinders being in alignment. A common piston rod extends between the two pistons and is attached by a fastening member to the inner cylinder, the fastening member extending through a slot in the outer cylinder. A valve receives compressed fluid, such as compressed air, and cyclically and alternately directs the compressed fluid to the two fluid powered cylinders to alternately raise the outer cylinder above the inner cylinder and to drive the upper cylinder downwardly into post driving contact with the upper end of a post held by the inner cylinder.

10 Claims, 5 Drawing Sheets

10
12
20
30
36
40
50
70
101
102
110

PORTABLE POST DRIVING APPARATUS

BACKGROUND OF THE INVENTION

This invention relates to a portable, power operated post driving apparatus that can be operated by a single person to drive a steel fence post, or other kinds of posts, into the ground in an expeditious manner.

Posts, particularly steel fence posts, have been driven into the ground in a number of different ways.

Originally, such posts were manually driven into the ground by using a sledge hammer. Other manually operated post drivers are described in U.S. Pat. Nos. 3,712,389 and 5,020,605. Such manually operated post driving devices are slow, and the human operator can become quickly fatigued.

Power driven post drivers of various sorts appear in the prior art. Examples include cam driven post drivers where an electric powered cam drives the hammer directly (U.S. Pat. No. 2,703,479) or where an electric or gas powered cam lifts the hammer and drops it (U.S. Pat. No. 4,984,640).

Various other power driven post drivers have been suggested by the prior art. These drivers use either compressed air or hydraulics to operate a fluid operated power cylinder arrangement wherein a weight assembly is lifted and lowered. One such device is described in U.S. Pat. No. 4,665,994 wherein the weight assembly comprises a metal disc and two solid metal bars. Such devices, although technically portable, are still very heavy because of the combination of the weight of the weight assembly and the weight of the remainder of the apparatus.

Commercially available portable pneumatic post drivers use large amounts of compressed air, typically from 25 cubic feet per minute up to 125 cubic feet per minute. Such drivers require a relatively large air compressor to supply compressed air to the driver.

It is an object of this invention to provided a portable power driven post driver that is light weight.

It is a further object of this invention to provide a portable power driven post driver that uses very little air or hydraulic fluid, and which can, therefore, be supplied by small, light weight, and portable fluid power sources.

SUMMARY OF THE INVENTION

This invention relates to a portable power driven post driver. The post driver has an inner hollow cylinder open at both ends and adapted to receive a post through a lock clamp located at its lower end. An outer hollow cylinder having a closed upper end, and slightly larger in diameter than the inner cylinder, is located in sliding engagement over the inner cylinder. First and second power cylinders are attached to upper and lower outer surfaces of the outer cylinder in alignment with each other. A common piston rod connects the pistons of the power cylinders. A stationary fastening pin extends through a slot in the wall of the outer cylinder and is attached to the wall of the inner cylinder. A valve and conduit means communicates the two power cylinders to a source of fluid under pressure.

During operation, a post is inserted through the lock clamp in the lower end of the inner cylinder until it abuts the closed upper end of the outer cylinder and is locked in place. The valve alternately communicates the fluid under pressure with the first and second power cylinders to alternately raise the outer cylinder above the inner cylinder and then to drive the outer cylinder downward until the closed end thereof forcefully contacts the upper end of the post. The outer cylinder has handle means attached thereto to permit an operator to carry and hold the driver during operation.

The post driver of this invention is thus configured to cause all of the weight of the driver except for the weight of the inner cylinder to drivingly engage a post to be driven.

DESCRIPTION OF THE PREFERRED EMBODIMENT

Figure 1A:
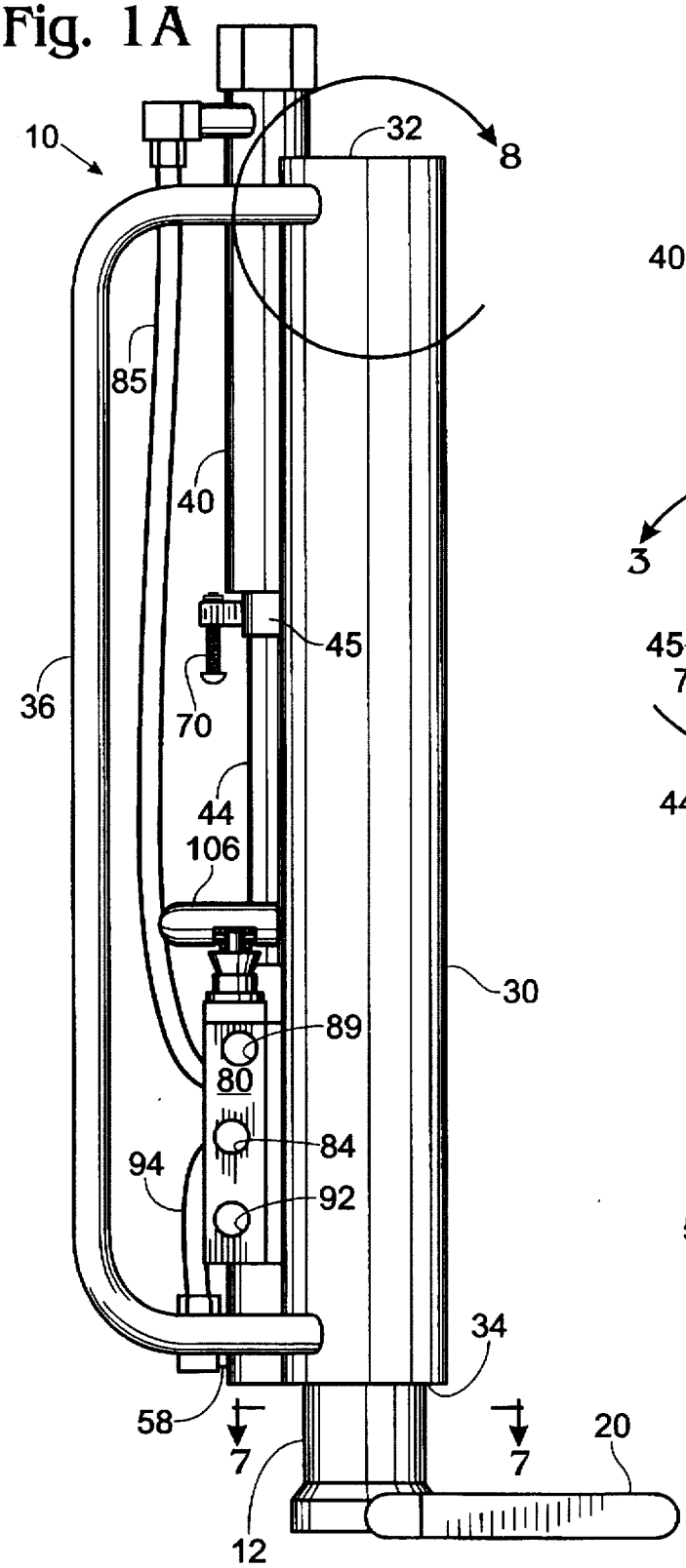
FIGS. 1A and 1B are elevational views of the post driver of this invention.
Figure 1B:
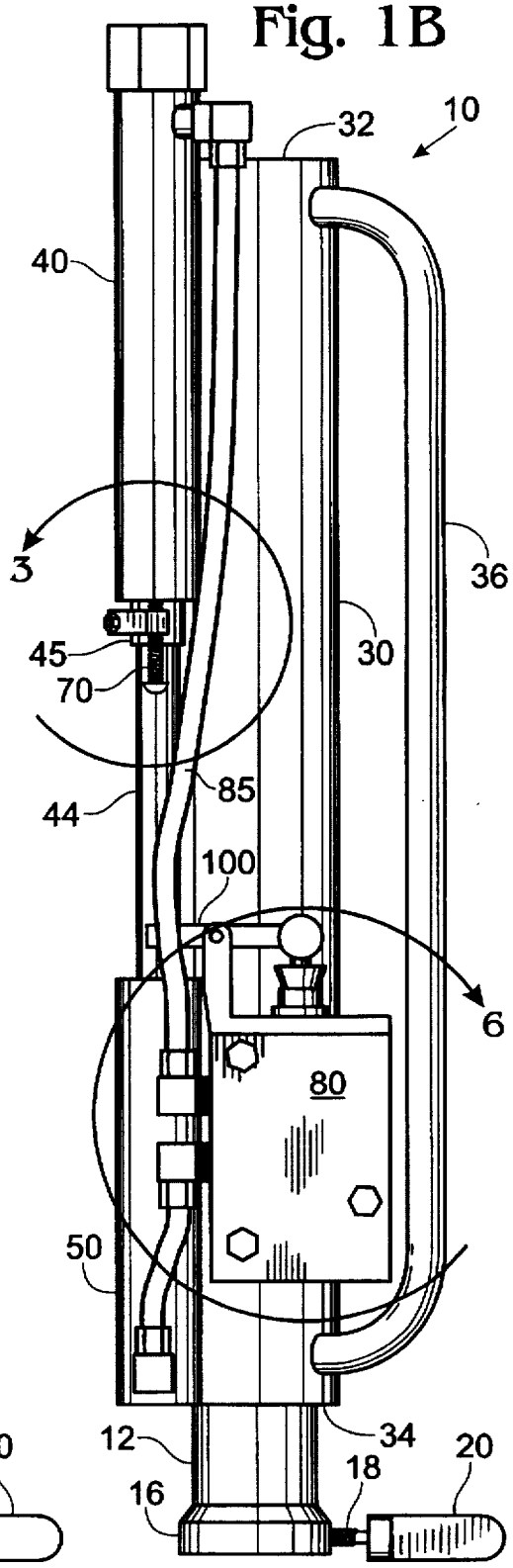

As seen in FIGS. 1A, 1B, 3 and 8, driver 10 has an inner hollow cylinder 12 open at its upper end 14. Attached to the lower end of inner cylinder 12 is a clamp sleeve 16 having threaded clamp pin 18 extending therethrough, clamp pin 18 having a clamp handle 20 attached to its outer end.

Figure 7:
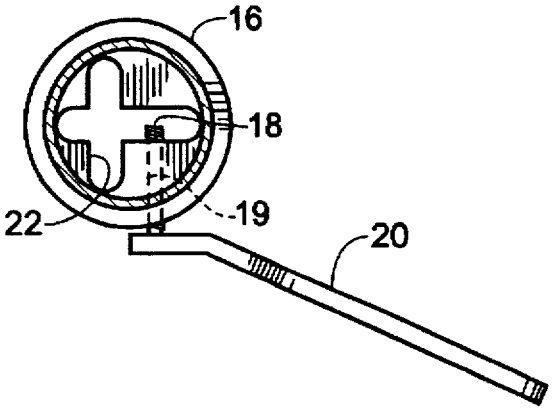
FIG. 7 is a bottom view of the post clamp sleeve, partially in section, taken along line 7—7 of FIG. 1A.

A bottom view of clamp sleeve 16, clamp pin 18 and clamp handle 20 is shown in FIG. 7. Clamp pin 18 has male threads received by the female threads of opening 19 in clamp sleeve 16. In the preferred embodiment illustrated in FIG. 7, clamp sleeve 16 has an opening 22 therein in the T-shape of the cross section of a conventional steel fence post. However, the invention is not limited to a driver for such steel fence posts. Other post shapes and posts of other materials can be driven by the driver of this invention by merely changing clamp sleeve 16 to one having an opening of a configuration such as to accommodate a selected shape.

Referring back to FIGS. 1A, 1B and 8, driver 10 has an outer hollow cylinder 30 closed at its upper end 32 and open at lower end 34. The inner diameter of outer cylinder 30 is slightly larger than the outer diameter of inner cylinder 12 to permit inner cylinder 12 to be nested inside outer cylinder 30 in sliding engagement. An operator's handle 36 is attached to the exterior of outer cylinder 30.

Figure 2:
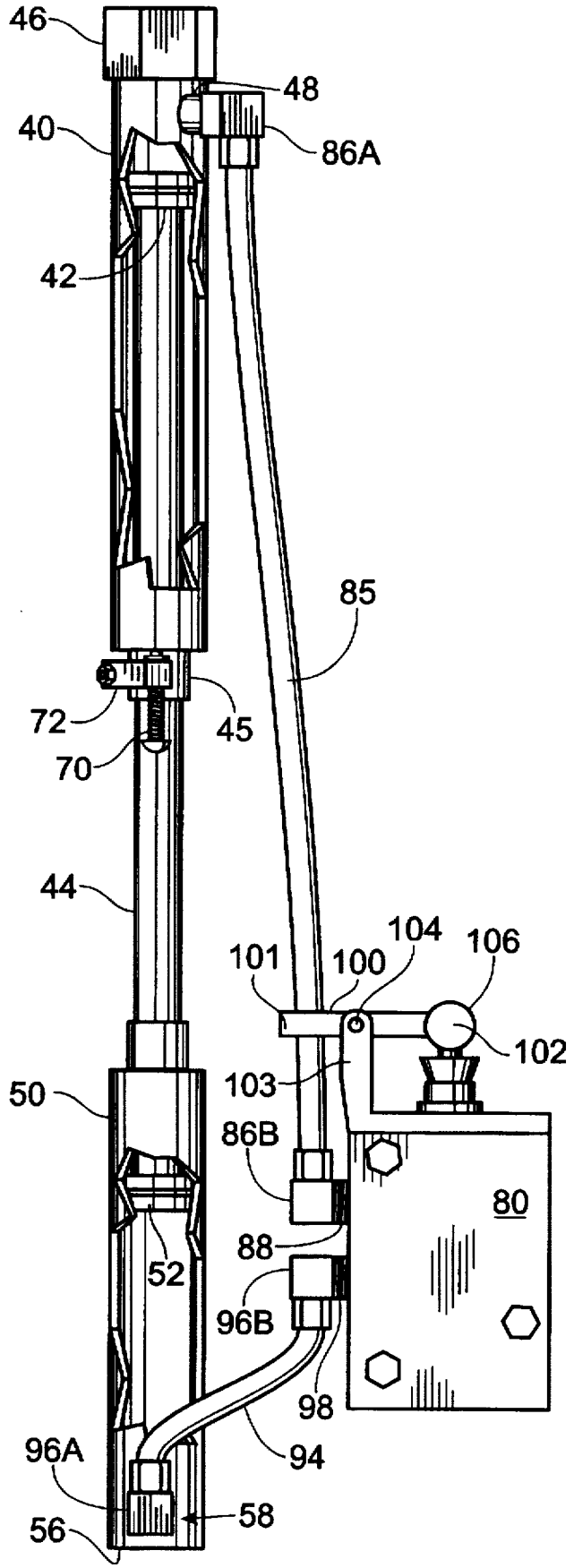
FIG. 2 is an elevational view, partially in section, of the power cylinders and valve.

An upper power cylinder 40 is fixedly attached to an upper outer surface of outer cylinder 30, such as by welding. Inside upper power cylinder 40, as seen in FIG. 2, is a piston 42 attached to the upper end of piston rod 44. The upper end of power cylinder 40 is threaded and has a screw cap 46 securely attached thereto. Threaded hollow fitting 48 communicates the inside of upper power cylinder 40 with the outside thereof in a location between screw cap 46 and piston 42 at the closest approach of piston 42 to screw cap 46.

A lower power cylinder 50 is fixedly attached to a lower outer surface of outer cylinder 30, such as by welding. Inside lower power cylinder 50, as best seen in FIG. 2, is a piston 52. The longitudinal axes of upper power cylinder 40 and lower power cylinder 50 are in alignment with each other, and piston rod 44 is attached at its lower end to piston 52. The bottom 56 of lower power cylinder 50 is closed. Threaded hollow fitting 58 communicates the inside of lower power cylinder 50 with the outside thereof in a location between bottom 56 and piston 52 at the closest approach of piston 52 to bottom 56.

Figure 3:
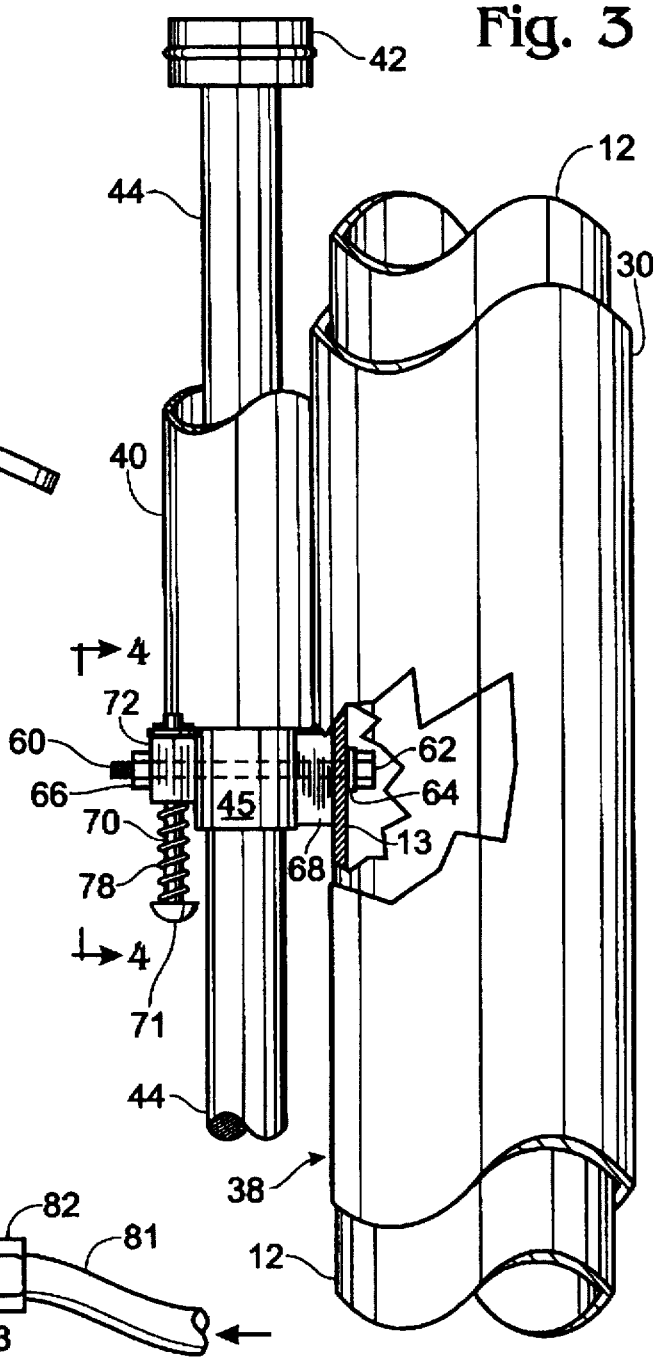
FIG. 3 is an enlarged view of that portion of the post driver enclosed within circle 3 of FIG. 1B, partially in section, which illustrates the piston rod fastener means and its relationship to the piston rod and inner and outer cylinders.
Figure 5:
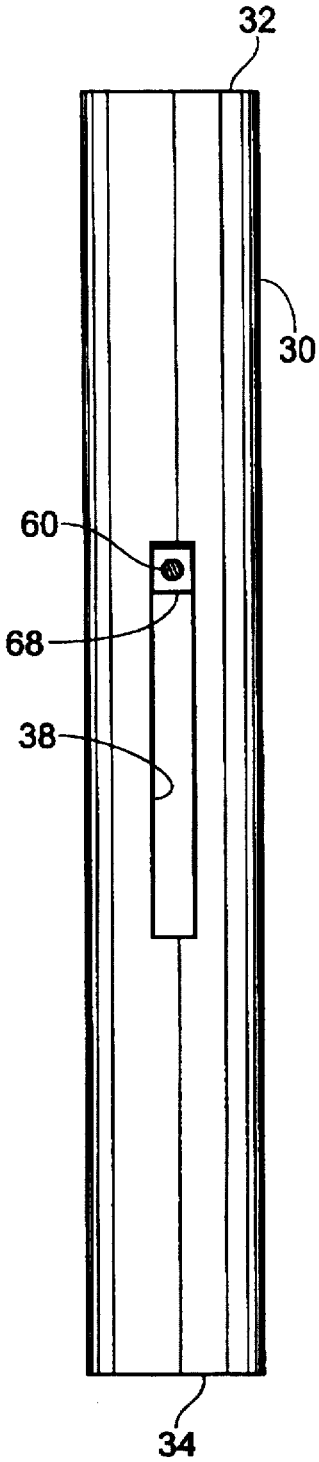
FIG. 5 is a side elevational view of the outer cylinder showing the slot therein through which the stationary piston rod fastening pin passes.

The manner of attachment of piston rod 44 to inner cylinder 12 is best understood by reference to FIG. 3. Upper power cylinder 40 is shown with piston rod 44 extending therefrom. The configuration shown in FIG. 3 is the same as that shown in FIGS. 1A, 1B, and 2, i.e., the outer cylinder 30 of driver 10 is in its retracted position with piston 42 being at its closest approach to screw cap 46. Extending through the cylindrical wall 13 of inner cylinder 12 and through a thick shouldered portion 45 of piston rod 44 is a fastening pin 60. Fastening pin 60 may be a threaded bolt, as illustrated, or other suitable fastening member. At its inner end, fastening pin 60 has a widened head 62 and associated washer 64, both located on the inside of the wall 13 of inner cylinder 12. A nut 66 is affixed to the outer end of fastening pin 60. Fastening pin 60 extends through slot 38 in the wall of outer cylinder 30; slot 38 is best seen in FIG. 5.

Between the outer wall of inner cylinder 12 and the enlarged shoulder portion 45 of piston rod 44 is a guide member 68 having a width slightly less than the width of slot 38 in outer cylinder 30. Guide member 68 travels in slot 38 as outer cylinder 30 reciprocates up and down during operation, and thus maintains the relative position of outer cylinder 30 to inner cylinder 12.

Figure 4:
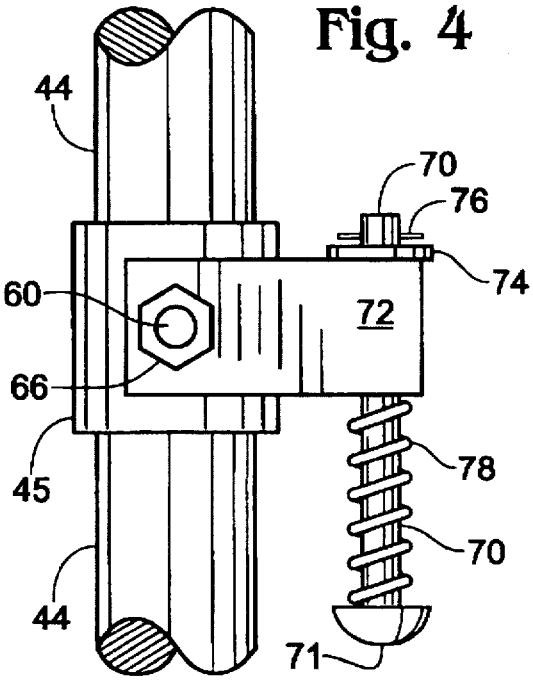
FIG. 4 is an elevational view of the deactuation pin taken along line 4—4 of FIG. 3.

As best seen in FIGS. 3 and 4, a deactivation pin 70 having an enlarged head 71 extends through an arm 72. Arm 72 is locked into place between the enlarged portion 45 of piston rod 44 and nut 66. At its outer end pin 70 is releasably held in place by a washer 74 and cotter pin 76, as best seen in FIG. 4. A spring 78 keeps deactivation pin 70 in a normally fully extended position, but permits it to retract upon application of a force to the enlarged head portion thereof, as will be more fully explained below.

Figure 6:
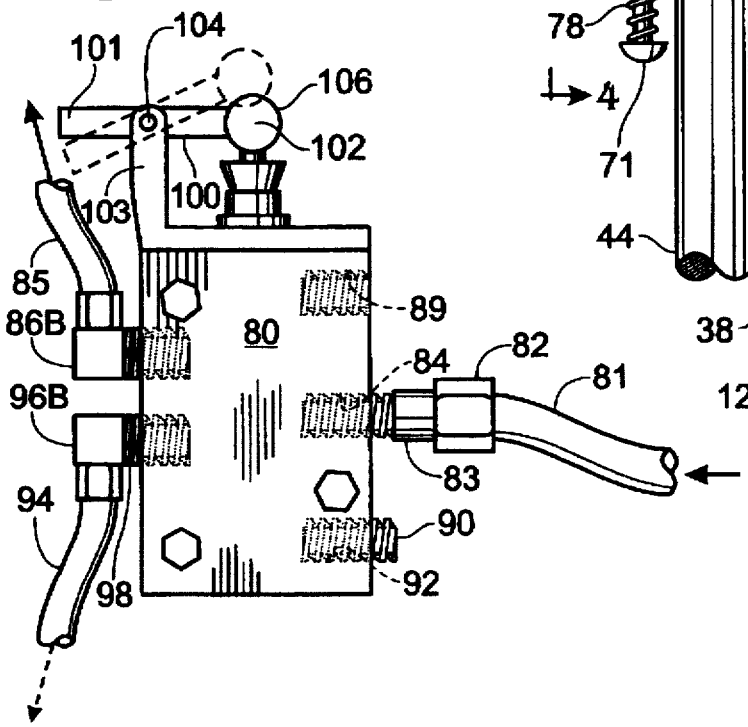
FIG. 6 is an enlarged side elevational view of that portion of FIG. 1B enclosed by circle 6, partially in section, which illustrates the valve and its control lever.

Valve 80, attached to the lower outer surface of outer cylinder 30, is a four way spool valve, such as Model No. 422CS011K manufactured by Parker. Fluid under pressure, such as compressed air from a compressor (not shown), is introduced into valve 80 (as best seen in FIGS. 2 and 6) via an elongated flexible air hose 81 having a quick release fitting connection 82 at its outer end. Quick release fitting 82 is connected to a corresponding quick release fitting 83 located in threaded opening 84 of valve body 80.

As best seen in FIG. 2, compressed air is introduced into upper power cylinder 40 from valve 80 via rigid air hose 85 having suitable fittings 86A and 86B at each end thereof. Fitting 86A is connected to hollow fitting 48 of upper power cylinder 40 and fitting 86B is connected to valve 80 via a threaded hollow fitting 88 which communicates the inside of valve 80 with the outside thereof.

Compressed air is introduced into lower power cylinder 50 from valve 80 via rigid air hose 94 having suitable fittings 96A and 96B at each end thereof. Fitting 96A is connected to hollow fitting 58 of lower power cylinder 50 and fitting 96B is connected to valve 80 via a threaded hollow fitting 98 which communicates the inside of valve 80 with the outside thereof.

As seen in FIG. 6, a speed control fitting 90 located in the exhaust port 92 of valve 80 controls the flow rate of exhaust air from lower power cylinder 50 by the selection of the size of an orifice located inside fitting 90.

Located on the top of valve 80 is a control lever 100 having an inner end 101 and an outer end 102. Control lever 100 is pivotally attached to U-shaped arm 103 by pin 104 and has a small handle 106 extending perpendicularly from the outer end 102 thereof.

Figure 8:
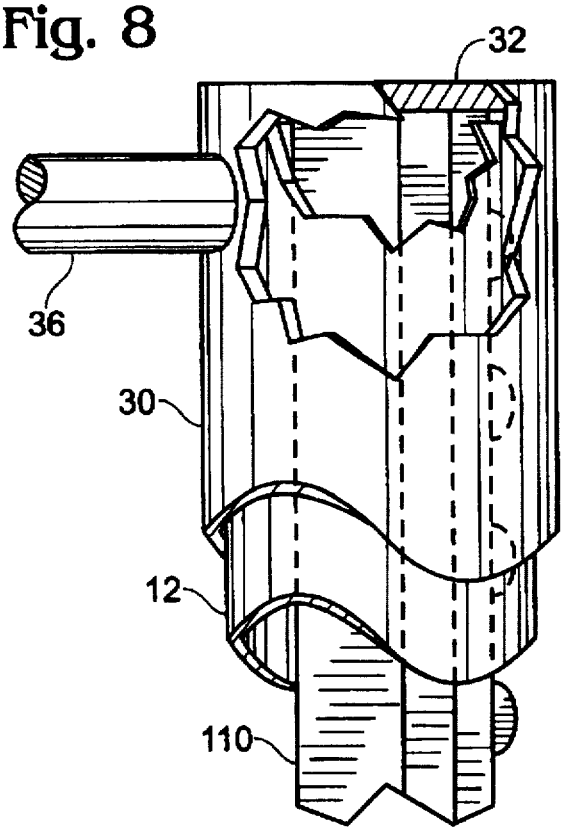
FIG. 8 is an enlarged view of that portion of FIG. 1A enclosed by circle 8, partially in section, which illustrates the upper end of the post driver.

In operation valve 80 is connected to a compressed air source via flexible hose 81 and fittings 82 and 83 with control lever 100 being in the up (off) position shown in phantom in FIG. 6. A post 110 (such as a conventional steel fence post having a T-shaped cross section) is inserted into inner cylinder 12 through T-shaped opening 22 in clamp sleeve 16 while the driver 10 is in a substantially horizontal position. The lower end of post 110 is placed at the location where the post is to be driven into the ground, driver 10 raised to a substantially vertical position, and post 110 caused to slide into inner cylinder 12 until the upper end of post 110 firmly contacts closed end 32 of outer cylinder 30, as shown in FIG. 8. Post 110 is then locked into place by turning clamp handle 20 attached to threaded clamp pin 18 clockwise until the inner end of clamp pin 18 firmly contacts post 110.

Figures 9A, 9B, 9C, 9D:
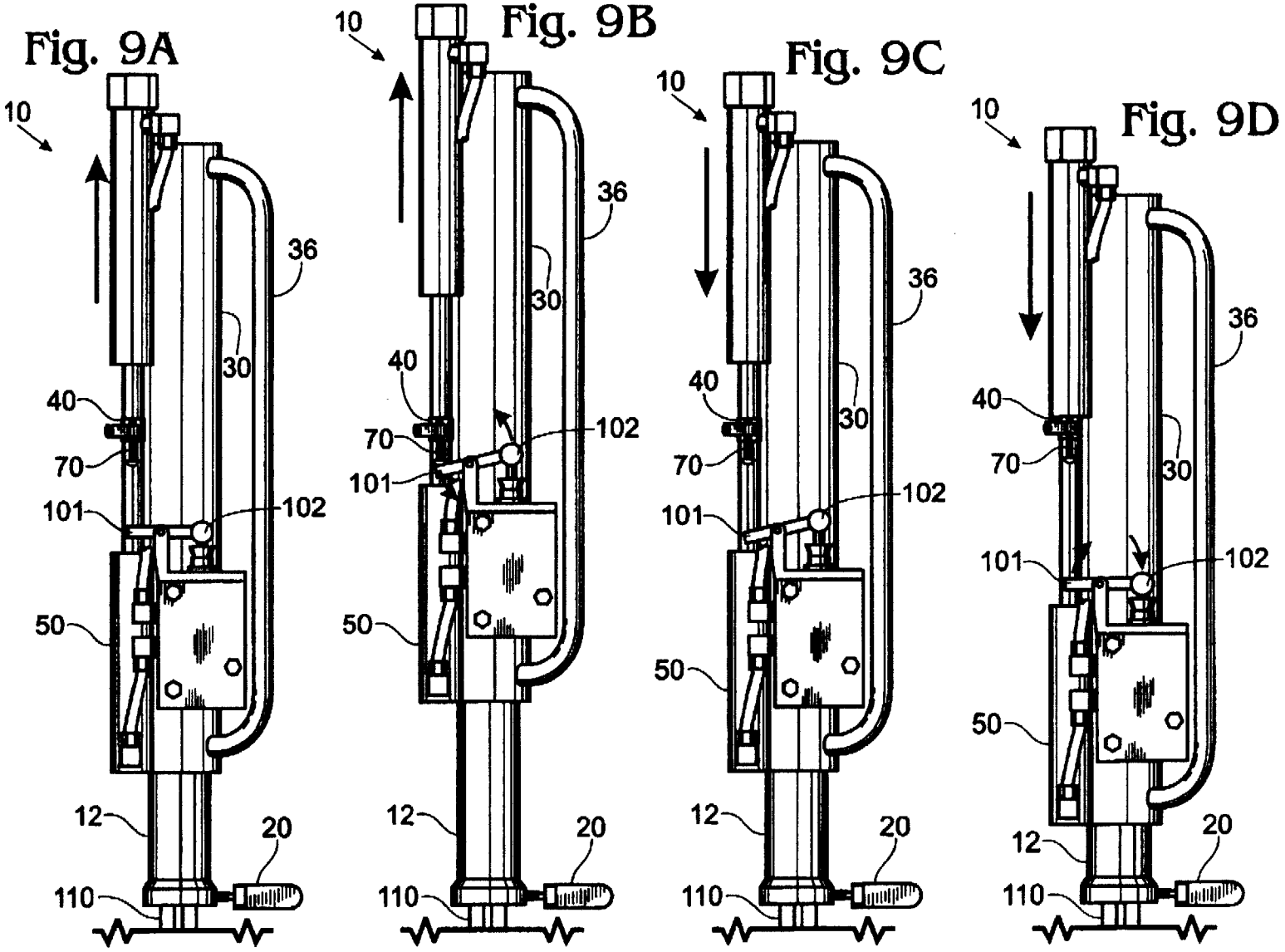
FIGS. 9A–9D are elevational views of the driver in various stages of operation.

During start-up, control lever 100 of valve 80 is in its up (off) mode thereby causing compressed air to flow from valve 80 to lower power cylinder 50, which keeps outer cylinder 30 in its retracted position. To actuate driver 10 the operator pushes down on handle 106 of control lever 100 to place valve 80 into its on (operating) mode, as illustrated in FIG. 6. In its initial operating mode, as seen in FIG. 9A, valve 80 causes air to flow from valve 80 into upper power cylinder 40 via rigid hose 85. Compressed air flowing into upper power cylinder 40 pushes downwardly on piston 42. Since piston rod 44 is fixedly attached to inner cylinder 12 by means of fastening pin 60, downward pressure on piston 42 raises outer cylinder 30 together with everything attached to it, which is everything constituting driver 10 except inner cylinder 12.

As outer cylinder 30 approaches its outermost vertical extension, as shown in FIG. 9B, the outer end 101 of control lever 100 contacts, and is pushed down by, spring loaded deactivation pin 70. This contact raises the inner end 102 of control lever 100, thereby automatically shutting off communication of the compressed air to upper power cylinder 40 and opening communication between upper power cylinder 40 and the atmosphere via valve orifice 89. At the same time, valve 80 opens communication between the compressed air source and lower power cylinder 50. Compressed air entering lower power cylinder 50 via rigid hose 94 pushes against piston 52. This action drives outer cylinder 30 downwardly and into driving communication with the upper end of post 110, as shown in FIGS. 8 and 9D.

As closed end 32 of outer cylinder 30 strikes the upper end of post 110, the inertial forces generated causes the inner end 102 of control lever 100 to pivot downwardly (as shown by the arrows in FIG. 9D) and re-open communication between valve 80 and upper power cylinder 40, thereby once again raising outer cylinder 30.

The raising and driving cycle is automatically repeated until the post 110 is driven to its desired depth. At that point, the operator waits for a downward (driving) stroke of outer cylinder 30 and then raises handle 106 of control lever 100 upwardly to its off position. This causes compressed air to be fed to lower power cylinder 50 thus retaining outer cylinder 30 in its retracted position.

During driving of the post 110 into the ground, outer cylinder 30 and everything attached to it, including the handle 36 held by the operator, reciprocates up and down, driving the post 110 into the ground at the end of each downward or driving stroke of outer cylinder 30. The stroke of the piston is not very great, about 7.5 inches, so that the reciprocating motion of the handle 36 is not bothersome to the operator.

Power cylinders 40 and 50 are relatively small, having a bore of about 1.0 inch in diameter. As a result, a lower air pressure and a lower volume of air can be used compared to prior devices. Driver 10 is operated at an air pressure of less than about 100 psi, preferably between about 70 psi and about 90 psi. At a pressure of 85 psi, driver 10 uses about 2 cfm of air. The closest known commercial unit uses 25 cfm of air at 125 psi. Other commercial devices use as much as 125 cfm.

Driver 10, as described herein, weighs about 26 pounds. Commercial devices weigh more than 50 pounds, and as much as 90 pounds.

In commercial embodiments of this invention, driver 10 would have a safety shield (not illustrated) placed over exposed piston rod 44.

The invention claimed is:

1. A portable power driven post driver comprising:

an inner hollow cylinder open at an upper end for receiving and holding a post;

an outer hollow cylinder having a closed upper end;

said inner cylinder being located inside said outer cylinder in sliding engagement therewith;

a first fluid powered cylinder and piston attached to an upper outer surface of said outer cylinder;

a second fluid powered cylinder and piston attached to a lower outer surface of said outer cylinder, longitudinal axes of said first and second fluid powered cylinders being in alignment;

a piston rod connecting said first and second pistons, said piston rod being attached to said inner cylinder by fastening means extending through a slot in a wall of said outer cylinder;

a valve for receiving compressed fluid and cyclically directing fluid to said first fluid powered cylinder through a first conduit to raise said outer cylinder above said inner cylinder from a first position and then directing fluid to said second fluid powered cylinder through a second conduit to thereby drive said outer cylinder down to said first position.

2. The post driver of claim 1 wherein said valve is a four way spool valve.

3. The post driver of claim 1 wherein said valve has a pivotable control lever having inner and outer ends, said control lever causing said valve to direct fluid under pressure to said upper power cylinder when the inner end of said control lever is in a down position and to said lower power cylinder when the inner end of said control lever is in an up position, said post driver including a deactuation pin attached to said piston rod, the outer end of said control lever being in alignment with said deactuation pin whereby extension of said outer cylinder causes said deactuation pin to contact and push down on the outer end of said control lever to thereby raise the inner end thereof, said control lever being configured such that the inner end thereof drops to the down position upon application of an inertial force thereto, said inertial force being that generated by post driving contact of the closed upper end of said outer cylinder with the upper end of said post.

4. The post driver of claim 1 wherein a clamp sleeve is located at a lower end of said inner cylinder for securely fastening a post placed in said inner cylinder.

5. The post driver of claim 4 wherein said clamp sleeve has an opening therein for receiving said post, said opening have a cross sectional configuration corresponding to a cross sectional configuration of said post.

6. The post driver of claim 5 wherein said cross sectional configuration of said opening in said clamp sleeve is T-shaped.

7. The post driver of claim 1 including a handle attached to the outer surface of said outer cylinder.

8. The post driver of claim 1 wherein said upper and lower power cylinders are configured for pneumatic operation.

9. The post driver of claim 8 wherein said upper and lower power cylinders are configured to operate at an air pressure of less than about 100 psi.

10. The post driver of claim 9 wherein said upper and lower power cylinders are configured to operate at an air pressure of between about 70 and about 90 psi.

* * * * *